US007918280B2

(12) United States Patent
Mailand et al.

(10) Patent No.: US 7,918,280 B2
(45) Date of Patent: Apr. 5, 2011

(54) RADIAL INDEXING COMMUNICATION TOOL AND METHOD FOR SUBSURFACE SAFETY VALVE WITH COMMUNICATION COMPONENT

(75) Inventors: Jason C. Mailand, The Woodlands, TX (US); Bahr A. Glenn, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 11 days.

(21) Appl. No.: 12/030,725

(22) Filed: Feb. 13, 2008

(65) Prior Publication Data

US 2008/0190623 A1 Aug. 14, 2008

Related U.S. Application Data

(60) Provisional application No. 60/901,225, filed on Feb. 13, 2007.

(51) Int. Cl.
*E21B 43/112* (2006.01)
*E21B 23/00* (2006.01)

(52) U.S. Cl. ..... 166/298; 166/55.8; 166/240; 166/381; 175/284

(58) Field of Classification Search ..... 166/298, 166/381, 55, 55.2, 317, 240, 55.8; 175/284, 175/263

See application file for complete search history.

(56) References Cited

U.S. PATENT DOCUMENTS

| | | | | |
|---|---|---|---|---|
| 1,801,424 | A * | 4/1931 | Gray | 166/55.8 |
| 2,322,695 | A | 6/1943 | Kinzbach | |
| 2,457,277 | A * | 12/1948 | Schlumberger | 166/55.1 |
| 3,799,258 | A | 3/1974 | Tausch | 166/72 |
| 4,944,351 | A | 7/1990 | Eriksen et al. | 166/376 |
| 4,981,177 | A | 1/1991 | Carmody et al. | 166/376 |
| 5,127,476 | A | 7/1992 | Dickson et al. | 66/323 |
| 5,197,540 | A * | 3/1993 | Yagi et al. | 166/55.8 |
| 5,201,817 | A | 4/1993 | Hailey | 175/269 |
| 5,226,483 | A | 7/1993 | Williamson, Jr. | 166/375 |
| 5,249,630 | A | 10/1993 | Meaders et al. | 166/373 |
| 5,496,044 | A | 3/1996 | Beall et al. | 277/1 |

(Continued)

FOREIGN PATENT DOCUMENTS

GB 2344122 5/2000

(Continued)

OTHER PUBLICATIONS

PCT International Search Report and Written Opinion dated Jul. 3, 2008, for corresponding PCT/US2008/053863.

(Continued)

*Primary Examiner* — Jennifer H Gay
(74) *Attorney, Agent, or Firm* — Zarian Midgley & Johnson PLLC

(57) ABSTRACT

A communication tool apparatus is described which is adapted to provide selective communication of control fluid through a downhole tool, such as a safety valve. The downhole safety valve is a tubing retrievable subsurface safety valve ("TRSSSV"). The communication tool may be run downhole and within the TRSSSV. Once within the TRSSSV, the communication tool apparatus activates a cutting device within the TRSSSV such that communication of control fluid through the TRSSSV is possible. A replacement safety valve run on a wireline may then be inserted into the TRSSSV and be operated via the control fluid line, as a new communication path created by the communication tool described herein. A method of using the communication tool apparatus is also described.

19 Claims, 17 Drawing Sheets

U.S. PATENT DOCUMENTS

| | | | | |
|---|---|---|---|---|
| 5,564,675 | A | 10/1996 | Hill, Jr. et al. | 251/62 |
| 5,598,864 | A | 2/1997 | Johnston et al. | 137/68.16 |
| 5,690,170 | A * | 11/1997 | Hailey et al. | 166/55 |
| 5,799,949 | A | 9/1998 | Beall et al. | 277/1 |
| 6,155,150 | A * | 12/2000 | Cooper et al. | 83/13 |
| 6,260,850 | B1 | 7/2001 | Beall et al. | 277/314 |
| 6,283,477 | B1 | 9/2001 | Beall et al. | 277/314 |
| 6,352,118 | B1 | 3/2002 | Dickson et al. | 166/373 |
| 6,523,614 | B2 | 2/2003 | Dennistoun et al. | 166/375 |
| 6,659,185 | B2 | 12/2003 | Dennistoun et al. | 166/375 |
| 6,742,595 | B2 | 6/2004 | Dennistoun et al. | 166/375 |
| 6,880,641 | B2 | 4/2005 | Dennistoun et al. | 166/375 |
| 6,902,006 | B2 * | 6/2005 | Myerley et al. | 166/373 |
| 7,137,452 | B2 * | 11/2006 | McVicker | 166/373 |
| 7,188,674 | B2 | 3/2007 | McGavern, III et al. | 166/298 |
| 7,249,635 | B2 | 7/2007 | Dennistoun et al. | 166/373 |
| 7,475,733 | B2 * | 1/2009 | Dennistoun et al. | 166/373 |
| 2002/0150436 | A1 | 10/2002 | Mason et al. | 409/143 |
| 2002/0153139 | A1 | 10/2002 | Dennistoun et al. | 166/298 |
| 2003/0234104 | A1 | 12/2003 | Johnston et al. | 166/298 |
| 2004/0056224 | A1 * | 3/2004 | McVicker | 251/62 |
| 2005/0056414 | A1 | 3/2005 | Dennistoun et al. | 166/55.7 |
| 2005/0056430 | A1 | 3/2005 | Dennistoun et al. | 166/321 |
| 2005/0098210 | A1 | 5/2005 | Strattan et al. | 137/70 |
| 2005/0098325 | A1 | 5/2005 | Myerley et al. | 166/386 |

FOREIGN PATENT DOCUMENTS

| | | |
|---|---|---|
| GB | 2392688 | 3/2004 |
| WO | WO 2005/045180 | 3/2005 |

OTHER PUBLICATIONS

PCT Invitation to Pay Additional Fees and Partial Search Report, dated Feb. 9, 2009 for corresponding PCT Serial No. PCT/US2008/053864, filed Feb. 13, 2008.

PCT International Search Report and Written Opinion, dated Apr. 15, 2009 for corresponding PCT Serial No. PCT/US2008/053864, filed Feb. 13, 2008.

PCT International Preliminary Report on Patentability, dated Dec. 10, 2009 for corresponding PCT Serial No. PCT/US2008/053863, filed Feb. 13, 2008.

* cited by examiner

RADIAL INDEXING COMMUNICATION TOOL AND METHOD FOR SUBSURFACE SAFETY VALVE WITH COMMUNICATION COMPONENT

PRIORITY

This application claims the benefit of U.S. Provisional Application No. 60/901,225, filed on Feb. 13, 2007, entitled "RADIAL INDEXING COMMUNICATION TOOL FOR SUBSURFACE SAFETY VALVE WITH COMMUNICATION DEVICE," which is hereby incorporated by reference in its entirety.

BACKGROUND OF THE INVENTION

1. Field of the Invention

The present invention relates to the drilling and completion of well bores in the field of oil and gas recovery. More particularly, this invention relates to an apparatus to provide selective communication of control fluid through a downhole tool, such as a safety valve. A method of using the communication tool apparatus is also described.

2. Description of the Related Art

In the oil and gas industry, a production tubing string is typically run thousands of feet into a well bore. Generally, when running a tubing string downhole, it is desirable—and in some cases required—to include a safety valve on the tubing string. The safety valve typically has a fail safe design whereby the valve will automatically close to prevent production from flowing through the tubing, should, for example, the surface production equipment be damaged or malfunction.

Should the safety valve become inoperable, the safety valve may be retrieved to surface by removing the tubing string, as described hereinafter. The tubing retrievable subsurface safety valve ("TRSSSV") may be a flapper-type safety valve, a ball-seat type of valve, or other types of valves known in the art. The TRSSSV is attachable to production tubing string and generally comprises a flapper pivotally mountable on the lower end of the safety valve assembly by a flapper pin, for example. A torsion spring is typically provided to bias the flapper in the closed position to prevent fluid flow through the tubing string. When fully closed the flapper seals off the inner diameter of the safety valve assembly preventing fluid flow therethrough.

A flow tube is typically provided above the flapper to open and close the flapper. The flow tube is adapted to be movable axially within the safety valve assembly. When the flapper is closed, the flow tube is in its uppermost position; when the flow tube is in its lowermost position, the lower end of the flow tube operates to extend through and pivotally open the flapper. When the flow tube is in its lowermost position and the flapper is open, fluid communication through the safety valve assembly is allowed.

A rod piston contacts the flow tube to move the flow tube. The rod piston is typically located in a hydraulic piston chamber within the TRSSSV. The upper end of the chamber is in fluid communication, via a control line, with a hydraulic fluid source and pump at the surface. Seals are provided such that when sufficient control fluid (e.g. hydraulic fluid) pressure is supplied from surface, the rod piston moves downwardly in the chamber, thus forcing the flow tube downwardly through the flapper to open the valve. When the control fluid pressure is removed, the rod piston and flow tube move upwardly allowing the biasing spring to move the flapper and thus the valve, to the closed position.

On relatively rare occasions, the safety valve assembly may become inoperable or malfunction due to the buildup of materials such as paraffin, fines, and the like on the components downhole, e.g., such that the flapper may not fully close or may not fully open. Regardless, it is known to replace the TRSSSV by retrieving the safety valve assembly to surface by pulling the entire tubing string from the well and replacing the safety valve assembly with a new assembly, and then rerunning the safety valve and the tubing string back into the well.

Because of the length of time and expense required for such a procedure, it is known to run a replacement safety valve downhole within the tubing retrievable safety valve as described hereinafter. These replacement safety valves typically are run downhole via a wireline. Thus, these replacement safety valves are often referred to as wireline retrievable sub-surface safety valves ("WRSSSV"). Before inserting the wireline safety valve into the TRSSSV assembly, however, two operations are performed. First, the TRSSSV is locked in its open position (i.e., the flapper must be maintained in the open position); and second, fluid communication is established from the existing control fluid line to the interior of the TRSSSV, thus providing control fluid (e.g. hydraulic fluid) to the replacement wireline safety valve. Lockout tools perform the former function; communication tools perform the latter.

Various lockout tools are commercially available, and will not be further discussed herein. When it is desired to lock the safety valve assembly in its open position, the lockout tool is lowered through the tubing string and into the safety valve. The lockout tool is then actuated to lock the valve mechanism (e.g. the flapper) of the TRSSSV in the open position.

Before inserting the replacement safety valve or WRSSSV, communication is established between the hydraulic chamber of the TRSSSV and the internal diameter of the TRSSSV. The communication tool disclosed herein may be utilized to provide fluid communication between the inner diameter of the safety valve and the hydraulic chamber, so that the hydraulic control line from surface can be utilized to operate the replacement wireline safety valve.

Once communication has been established with the hydraulic line, the WRSSSV may be run downhole. The WRSSSV may resemble a miniature version of the TRSSSV assembly described above. The WRSSSV is adapted to be run downhole and placed within the inner diameter of the TRSSSV assembly described above. The WRSSSV typically includes an upper and lower set of seals that will straddle the communication flow passageway established by them communication tool so that the control line to the TRSSSV may be used to actuate the valve mechanism of the WRSSSV.

More specifically, the seal assemblies allow control fluid from the control line to communicate with the hydraulic chamber and piston of the WRSSSV in order to actuate the valve of the WRSSSV between the open and closed positions. Once the WRSSSV is in place, the wireline may be removed and the tubing string placed on production.

There are various methods of establishing communication used today. One such method involves inserting a communication tool downhole which must be radially aligned just fight in order for the cutter to cut the required communication point. Some of these tools require special sleeves which precisely position the communication tool in exact alignment.

There are disadvantages to these designs. If the alignment is off, the cutter will miss the intended communication point and communication will not be established. This may also lead to costly damage to the interior of the tool. Also, designing and installing the sleeves used to align the tools is costly and may introduce unnecessary leak paths in the tubing.

In view of the foregoing, there is a need in the art for, among others, a cost effective communication tool which establishes fluid communication without the need for alignment of the tool or the costly components associated therewith.

SUMMARY OF THE INVENTION

According to one embodiment, the invention relates to an assembly for establishing communication between a control fluid line from surface to the inner diameter of a downhole tool such as a safety valve. In a preferred embodiment, a communication device is provided to establish fluid communication between the control line and the inner diameter of a safety valve. Should a need arise where it is necessary to establish fluid communication between the control line and the interior of the safety valve (e.g., if the TRSSSV is no longer operable), an embodiment of a communication tool may be run into the safety valve. At a predetermined point, a cutter extends from the tool and will ultimately penetrate through a communication component in the TRSSSV. The communication component is installed in, and extends from, the non-annular hydraulic piston chamber of the TRSSSV. When the cutter is adjacent the communication component, application of a downward force causes the cutter to penetrate the communication component, thereby establishing communication between the control line and the inner diameter of the safety valve. A wireline replacement valve may then be run downhole, and operated utilizing the control line to surface.

According to a preferred embodiment, the cutter of the communication tool does not have to be axially aligned with the communication component of the TRSSSV prior to actuating the communication tool. The cutter is extended from the communication tool once the tool has been locked into position inside the TRSSSV. The cutter extends into an internal recess on the inner diameter of the TRSSSV. With the cutter in the extended position, downward jarring on the central prong of the tool causes radial displacement of the cutter. A return spring and indexing spring combine to cause the cutter to index a pre-selected amount when the jarring weight is removed from the central prong. Following rotation, jarring is commenced again. The cutter will index through 360 degrees with continued jarring and rotating steps. The cutter will contact the communication component at least once per complete revolution.

Figure 1:
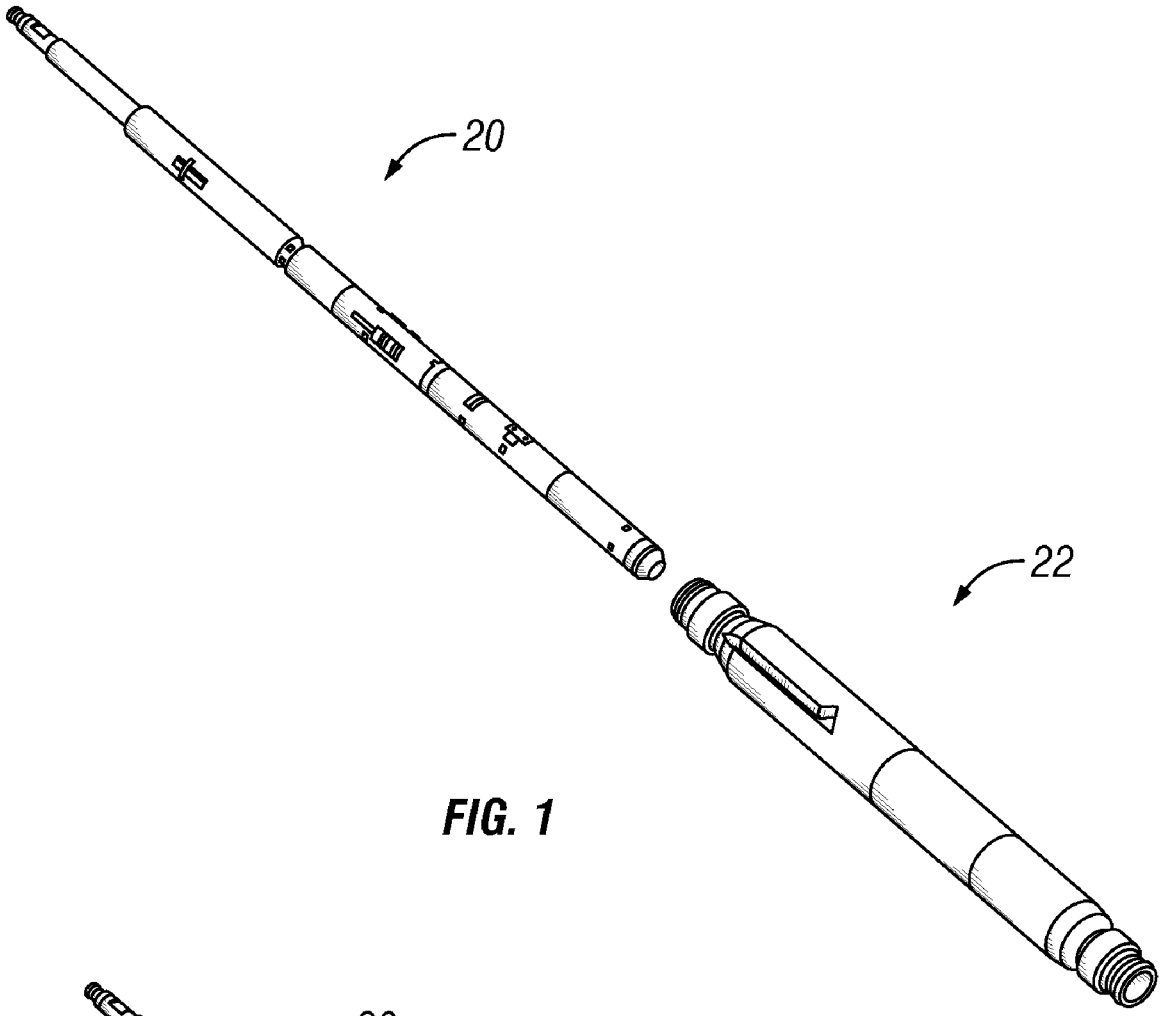
FIG. 1 shows a communication tool being run into the TRSSSV according to an exemplary embodiment of the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in the oil and gas well. In the interest of clarity, not all features of an actual implementation are described in this specification. It will of course be appreciated that in the development of any such actual embodiment, numerous implementation-specific decisions must be made to achieve the developers' specific goals, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments of the invention will become apparent from consideration of the following description and drawings.

Embodiments of the invention will now be described with reference to the accompanying figures.

Figure 2:
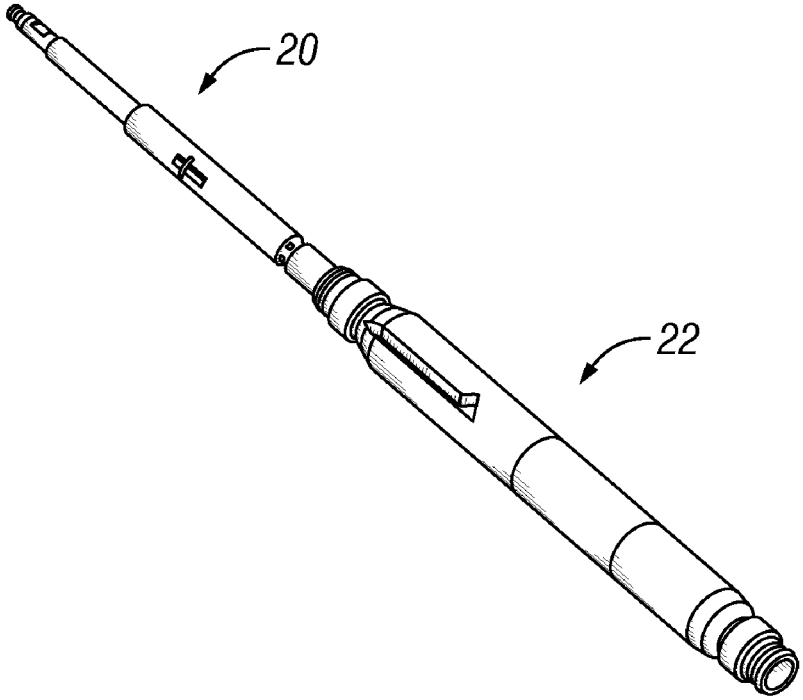
FIG. 2 shows the communication tool of FIG. 1 set and locked into the TRSSSV.

FIG. 1 illustrates one exemplary embodiment of a communication tool 20 being run into the tubing retrievable subsurface safety valve (TRSSSV) 22. Although not shown, it is understood that the TRSSSV 22 is connected to a production tubing string. As shown in FIG. 2, the communication tool 20 is set and locked into the TRSSSV 22.

Figure 3:
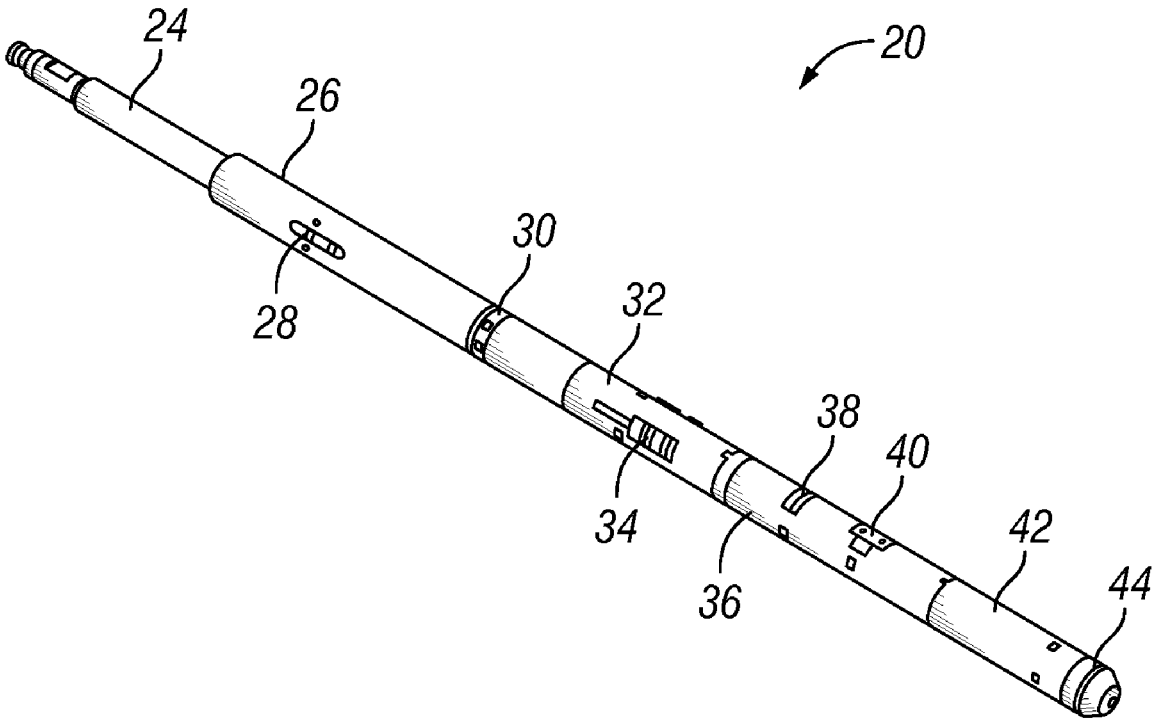
FIG. 3 shows the communication tool of FIG. 1 in the running mode.

FIG. 3 illustrates the components of a preferred embodiment of the communication tool 20. The communication tool 20 includes a central prong 24, index housing 26, indexing spring 28, running shear pin 30, lock body 32, lock dogs 34 (illustrated in the retracted position), cutter housing 36, cutter 38 (illustrated in the retracted position), reaction dog 40 (also illustrated in the retracted position), lower housing 42 and nose 44. In the running mode, the central prong 24 is held from axial movement by the running shear pin 30. In this mode, the cutter 38 is retracted and the lock dogs 34 can radially seek the appropriate lock profile in the TRSSSV 22.

Figure 4:
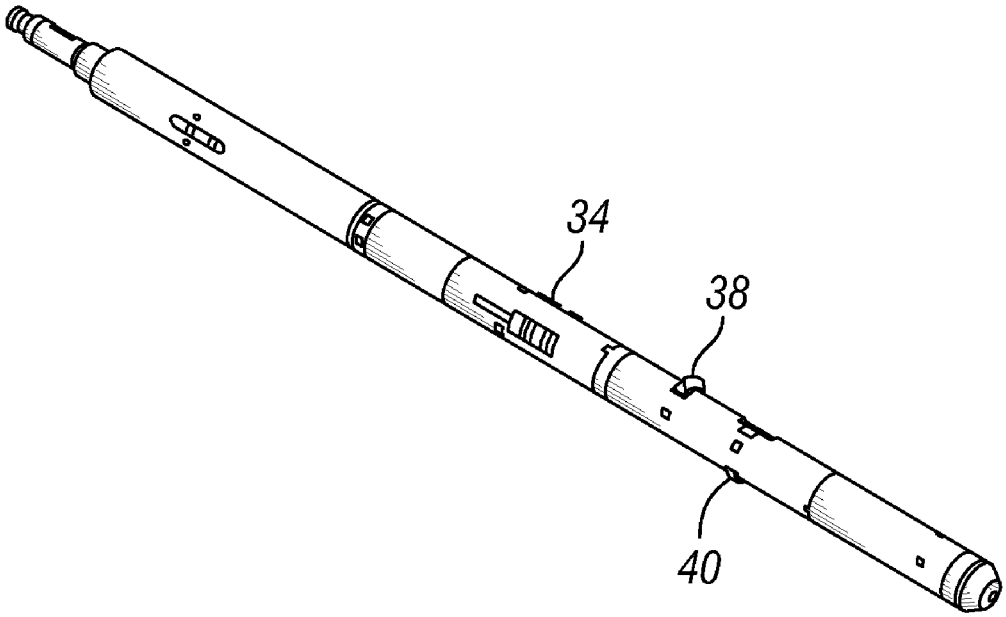
FIG. 4 shows the communication tool of FIG. 1 in the jarring mode.

In the jarring mode, as shown in FIG. 4, the central prong 24 is driven down into the communication tool 20 forcing the cutter 38 and reaction dog 40 to extend radially. If the cutter 38 makes contact with the exposed communication component 68 in the safety valve, hydraulic communication will be established. If the communication component 68 is not contacted, the central prong 24 and wireline weight bar (not shown) will be lifted until a fixed weight is registered. Upon pickup, the cutter housing 36 will rotate a fixed amount (e.g., 60°) positioning the cutter 38 for another radial cut on jarring. For purposes of this disclosure, the terms indexing and rotating are used interchangeably to denote rotating the cutter 38 a fixed amount around the axis of the communication tool 20. The indexing of the cutter 38 is continued until the communication component 68 is penetrated and/or severed. The communication tool 20 is recovered by jarring up to sever the pulling shear pin 30 located within the lock piston assembly. The lock dogs 34, cutter 38 and reaction dogs 40 will all retract for pulling out of the well.

Figure 5A:
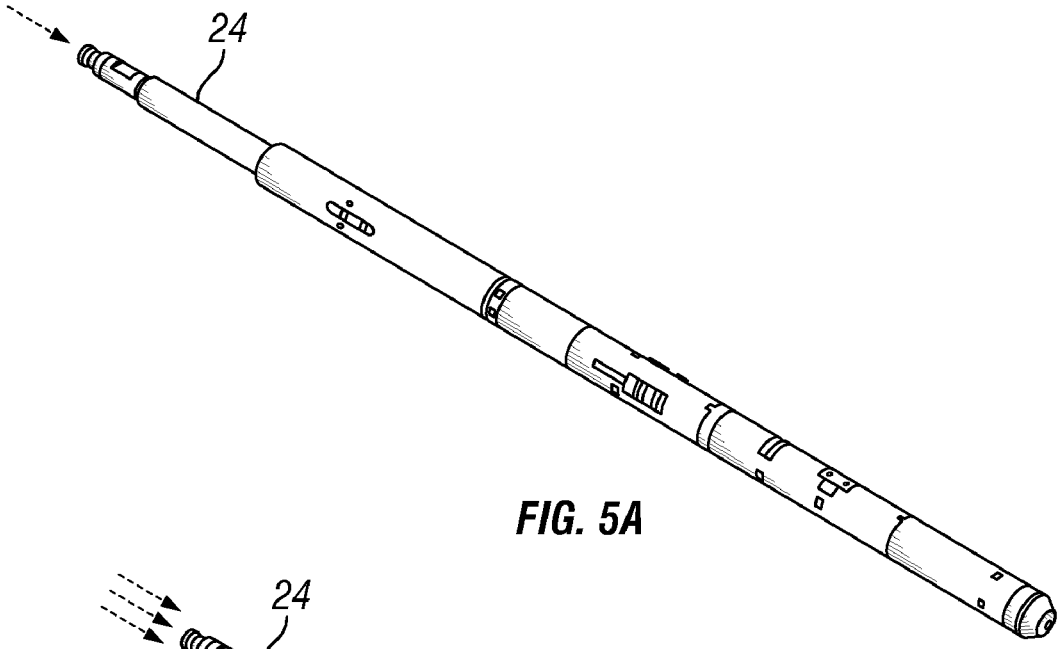
FIGS. 5A-5G show the communication tool of FIG. 1 in various modes, including the first 75 degrees of the available 360 degrees of rotation of the tool.
Figure 5B:
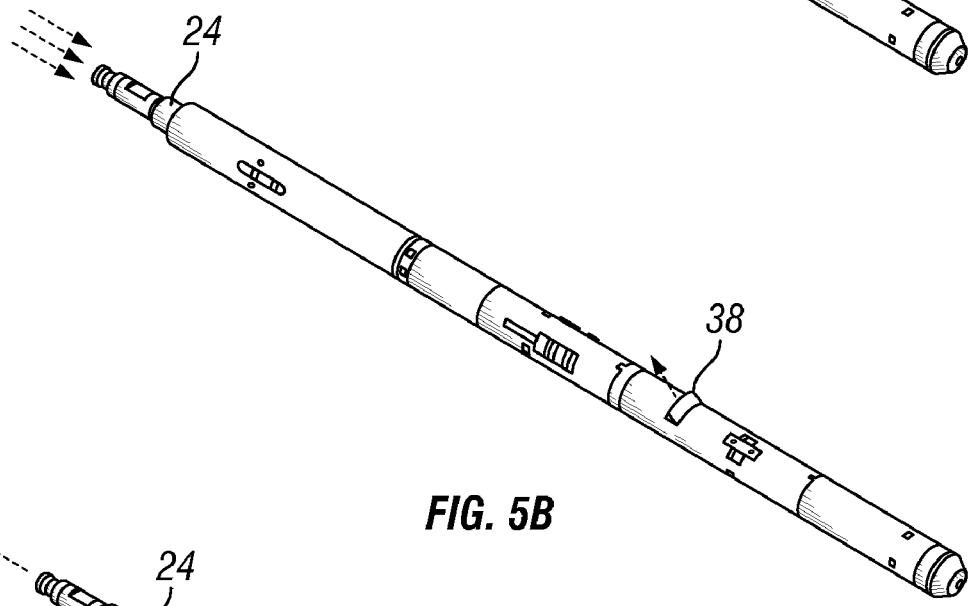
Figure 5C:
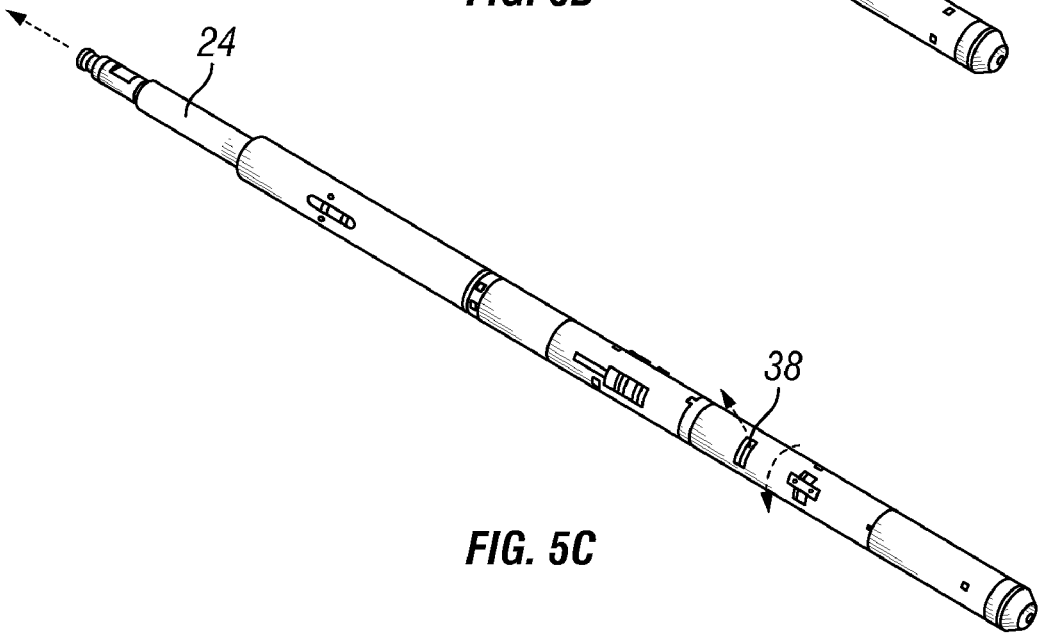
Figure 5D:
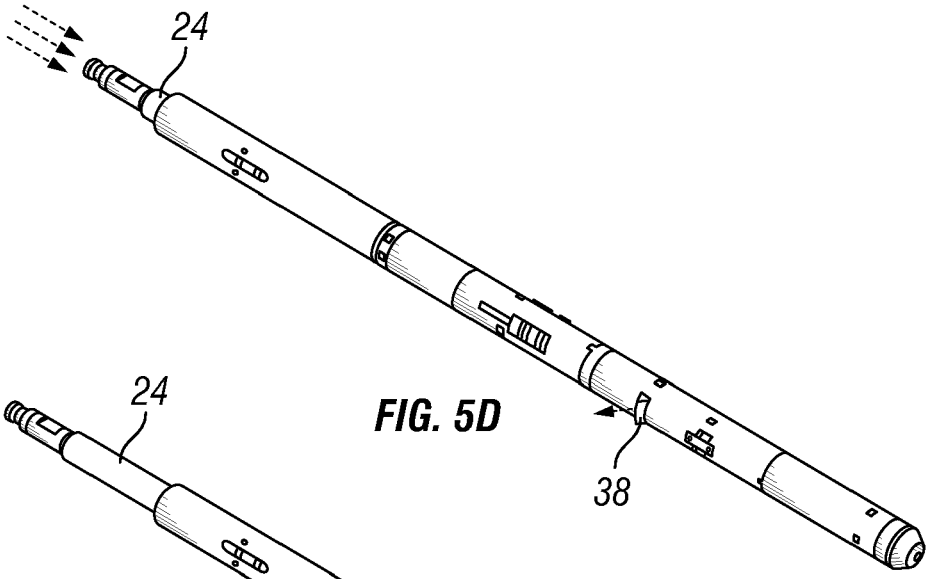
Figure 5E:
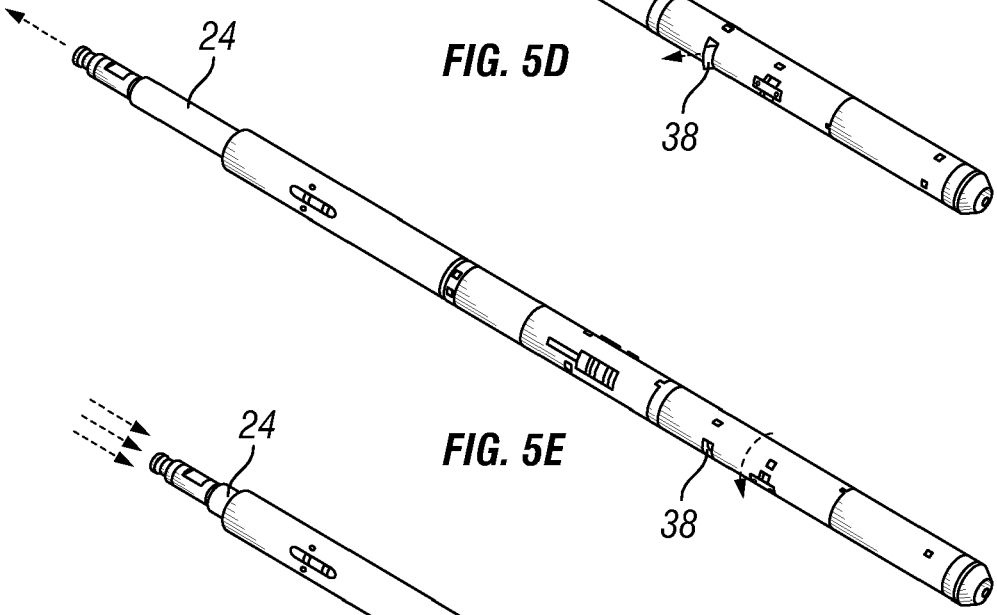
Figure 5F:
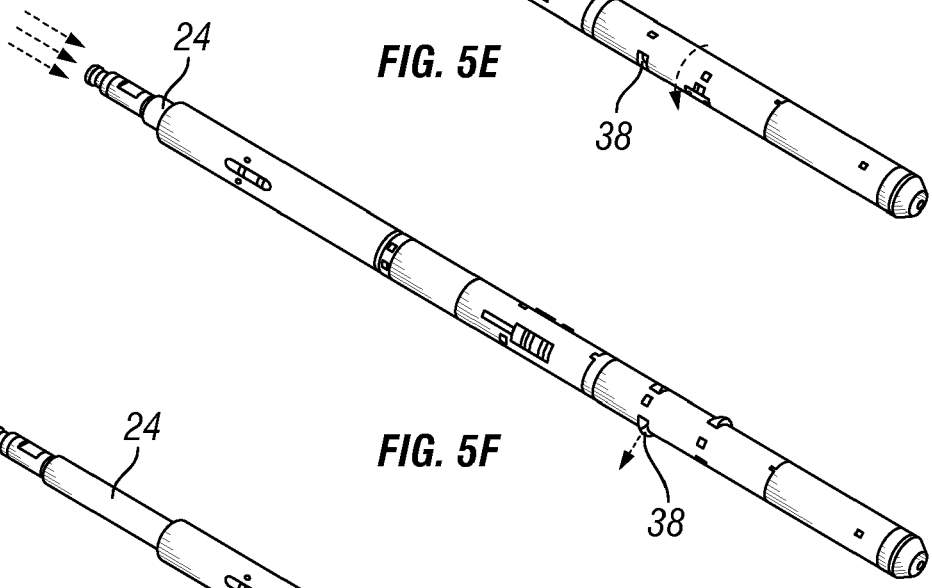
Figure 5G:
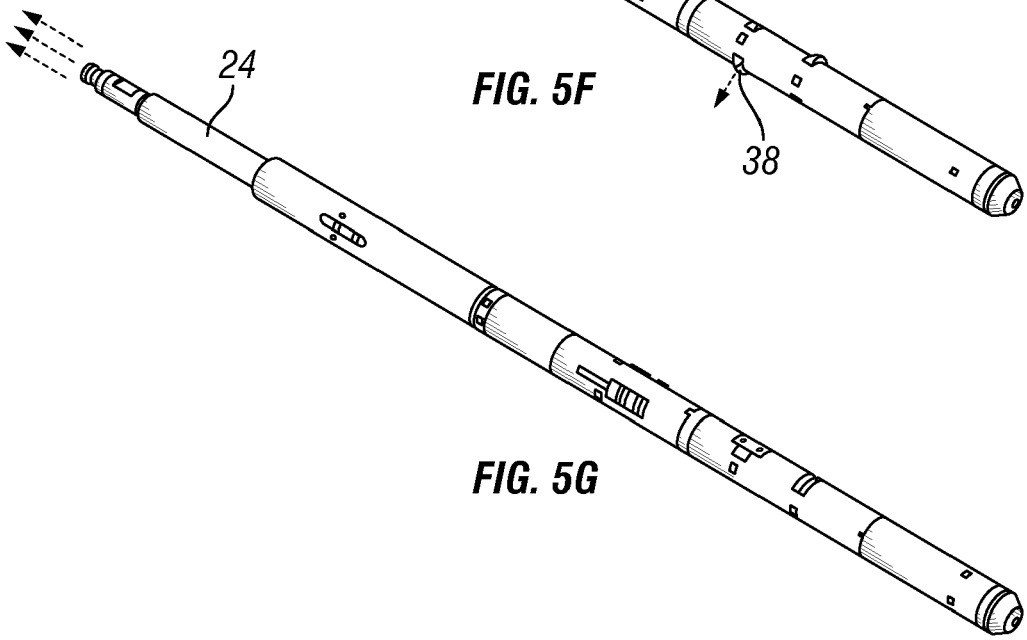

FIGS. 5A-5G show the first 180° of the available 360° of possible rotation during various modes of operation. FIG. 5A illustrates the communication tool 20 being run into the wellbore. During this mode of operation, the running shear pin 30 is severed, the lock dog 34 seeks the lock profile in the TRSSSV 22 and the pulling shear pin 46 (FIG. 8C) is set. FIG. 5B illustrates the Jarring/Cut Mode wherein central prong 24 is forced downward, thereby forcing cutter 38 outward. FIG. 5C illustrates the Lift/Rotate Mode wherein central prong 24 is forced upward, thereby retracting cutter 38 and rotating cutter housing 36. FIG. 5D again illustrated the Jarring/Cut Mode wherein central prong 24 is forced downward, thereby forcing cutter 38 outward. FIG. 5E again illustrates the Lift/Rotate Mode wherein the pressure on central prong is released, thereby retracting cutter 38 and forcing cutter housing 36 to rotate. FIG. 5F again illustrates the Jarring/Cutting Mode wherein central prong 24 is forced downward, thereby forcing cutter 38 to move outward. FIG. 5G illustrates the tool 20 being removed from the wellbore after the pulling shear pin 46 is severed by upward jarring.

The intermediate views show the jarring/pulling steps within FIGS. 5A-5G. In a preferred embodiment discussed above, the cutter 38 is extended only during the jarring mode of operation. The upper jarring is done to completely recover the tool, otherwise, the operator pulls a load against the pulling shear pin 46 (FIG. 8C) to let the operator know that the tool 20 is indexing over to the next position (i.e., the cutter rotates a pre-determined amount) for further jarring.

Figure 6A:
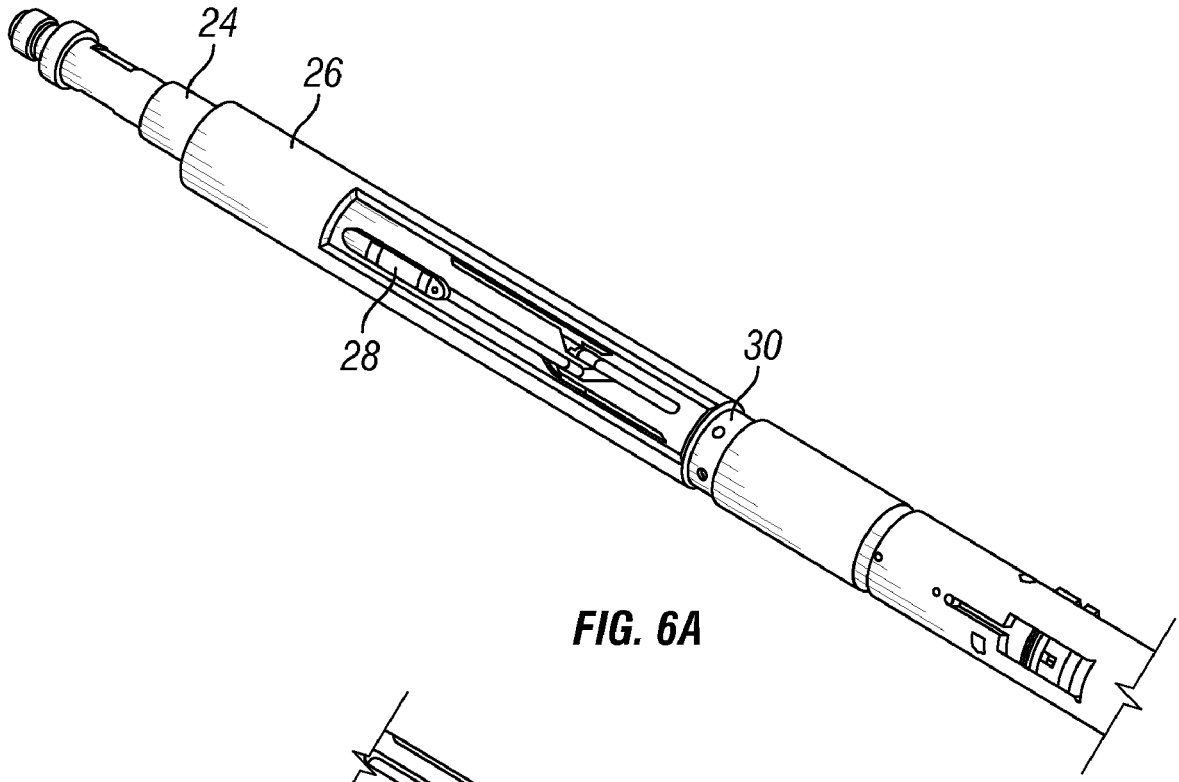
FIGS. 6A-6C illustrate the indexing springs and indexing profiles of a communication tool according to an exemplary embodiment of the present invention.
Figure 6B:
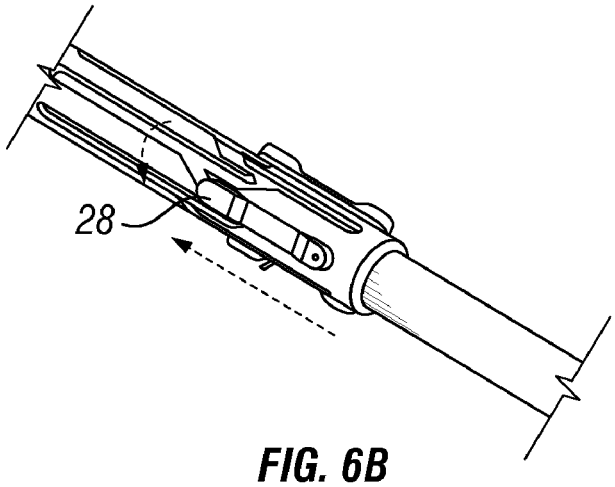
Figure 6C:
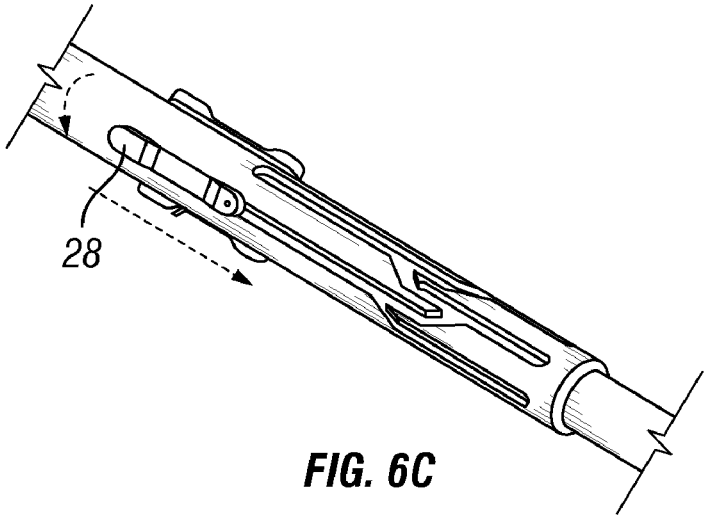

As illustrated in FIGS. 6A-6C, when the central prong 24 is driven down and when it is pulled up, the indexing springs 28 running in the indexing profiles 60 (FIG. 13) force the prong 24 to make, for example, two 30° counterclockwise rotations, effectively indexing the cutter 38 by 60° increments for every downward jarring/cutting cycle.

Figure 7:
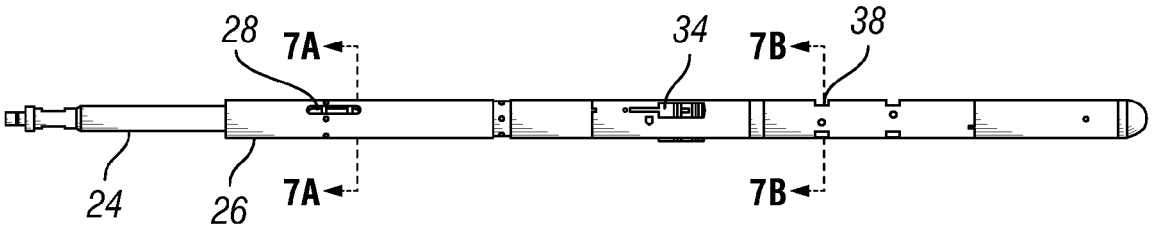
FIG. 7 shows the indexing springs and the cutter system for an exemplary embodiment of the communication tool.
Figure 7A:
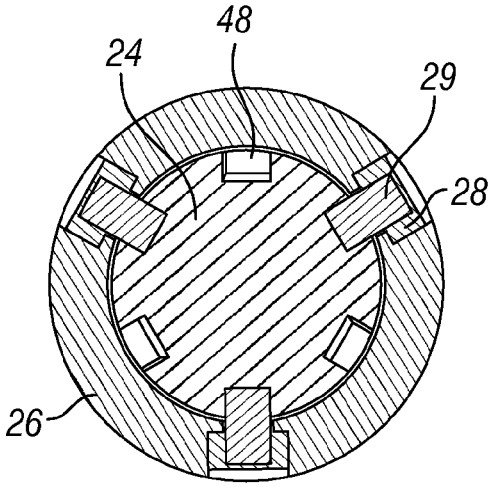
FIG. 7A shows a section view taken along the line A-A in FIG. 7.
Figure 7B:
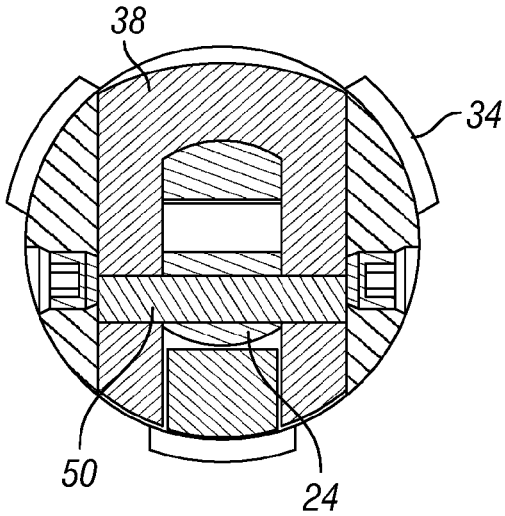
FIG. 7B is a section view taken along the line B-B in FIG. 7.

FIG. 7 illustrates the indexing springs 28 and the cutter system for an embodiment of the communication tool 20. FIG. 7A shows a section view taken along the line A-A to illustrate the indexing springs 28. The indexing profile 60 (FIG. 13) on the outer diameter of the central prong 24 allow each of the indexing pins 29 on the plurality of index springs 28 to track in a mating groove, the shapes of which force the central prong 24 to rotate. FIG. 7B is a section view taken along the line B-B in FIG. 7 through the cutter system. The central prong 24 forces the extension pin 50 on the cutter 34 in and out radially during operation as will be discussed later. The reaction dog 34 is extended and retracted in the same manner.

Figure 13:
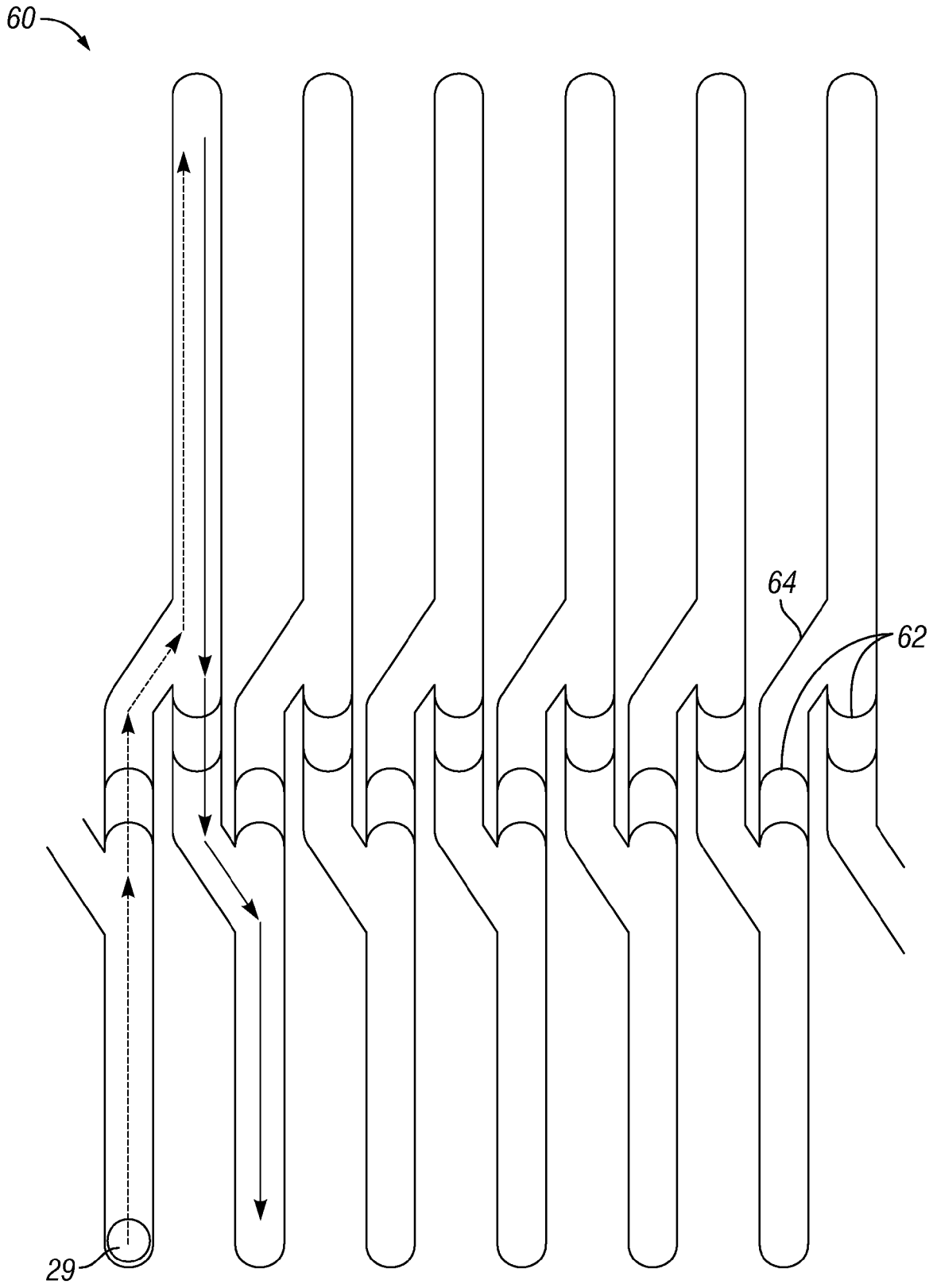
FIG. 13 illustrates the indexing profile according to an exemplary embodiment of the present invention.

FIG. 13 illustrates one exemplary embodiment of the indexing profiles 60 and an indexing pin 29 in movement therein. Ramps 62 and ledges 64 formed in the indexing profile 60 cause the central prong 24 to turn as the indexing pin 29 tracks through the indexing profile 60. Please note, however, those ordinarily skilled in the art having the benefit of this disclosure realize there are any number of ways to accomplish the indexing function of the present invention.

Figure 8A:
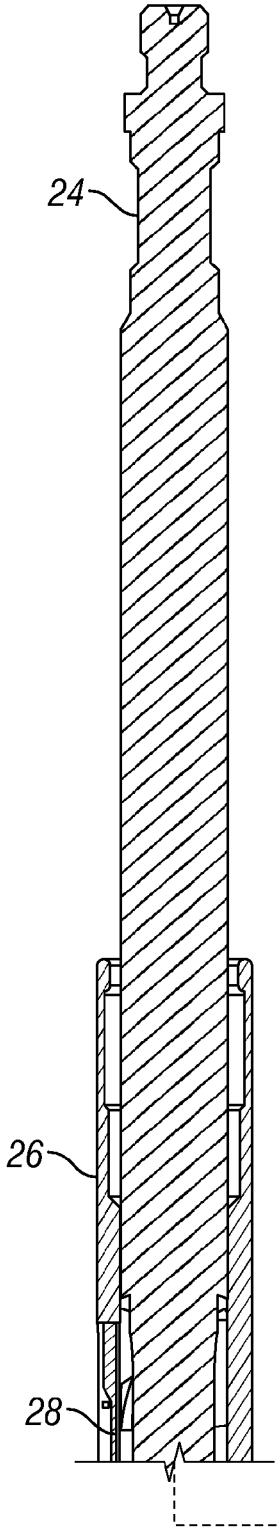
FIGS. 8A-8D show a sectional view of an exemplary embodiment of the communication tool in the running position after it has landed in a TRSSSV.
Figure 8B:
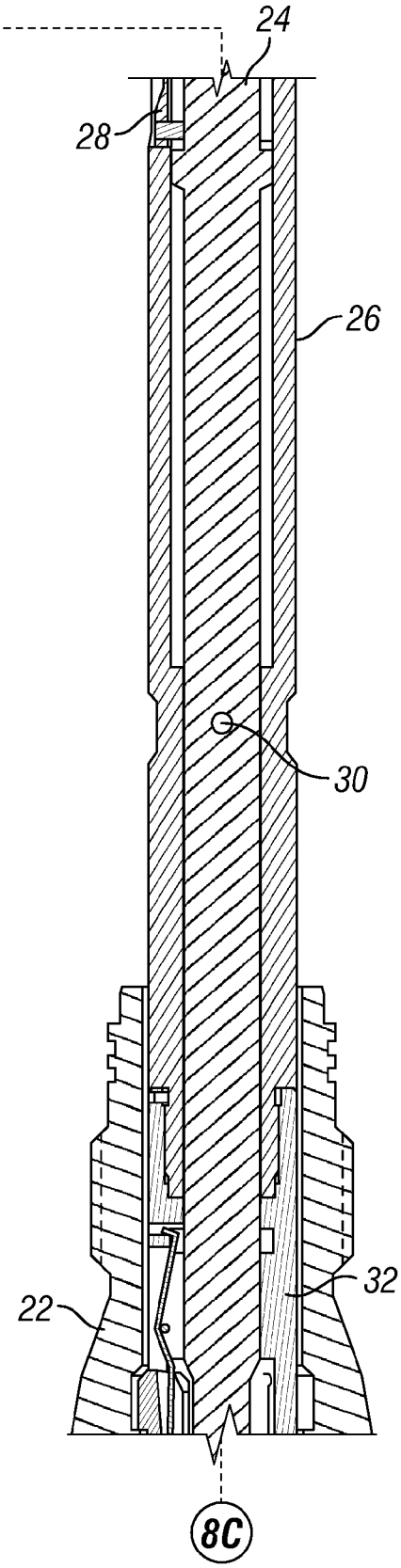
Figure 8C:
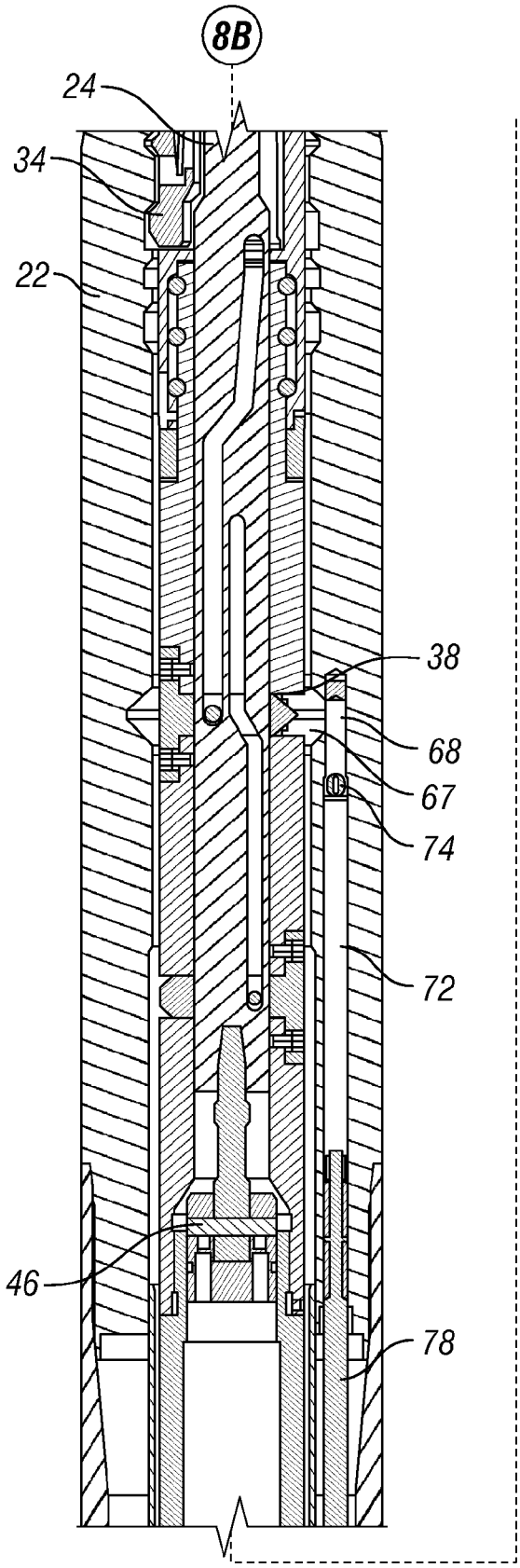

FIGS. 8A-8D illustrate an exemplary embodiment of communication tool 20 in the running position as it lands inside of the TRSSSV 22 in which communication is to be established. Central prong 24 extends longitudinally through the outer assembly of communication tool 20, the outer assembly including index housing 26, index springs 28, running shear pin 30 (shown intact) and lock body 32. The communication tool 20 is run inside of the production tubing and into the top of TRSSSV 22 until the lock dogs 30 are positioned adjacent to a mating profile in the safety valve hydraulic chamber housing. In this position, the cutter 38 is in the retracted position as illustrated in FIG. 8C. Here, the cutter 38 is adjacent a hydraulic chamber housing internal recess 67 which provides access to the upper end of the communication component 68. The communication component 68 is in communication with the piston bore 72 of the safety valve 22 via a communication retention ball 74. The retention ball 74 is press fitted inside of communication component 68, thereby retaining the component in the safety valve. The retention ball 74 includes an internal passageway 76 (FIGS. 12B-C) which provides communication between the communication component 68 and the piston bore 72.

Figure 8D:
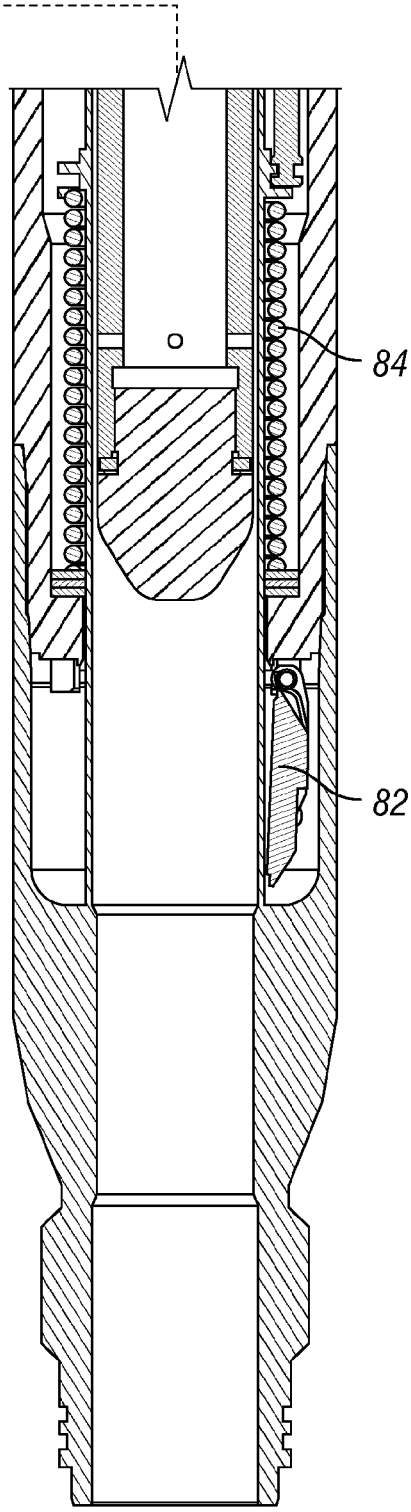
Figure 9A:
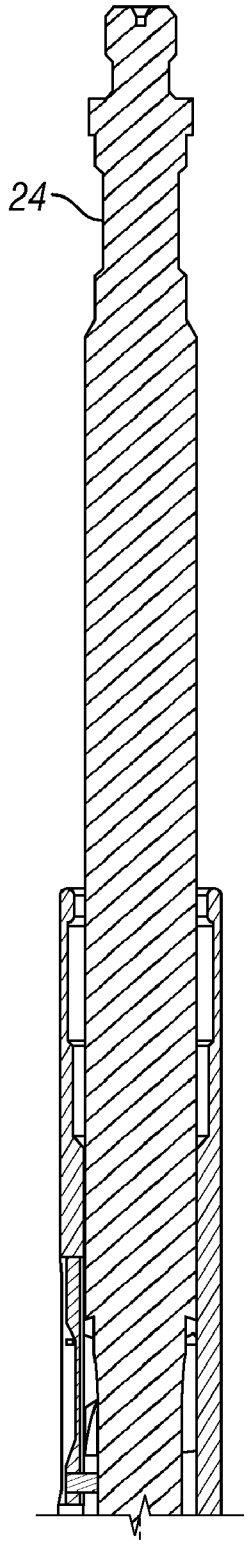
FIGS. 9A-9D show the communication tool of FIGS. 8A-8D in the indexing
Figure 9B:
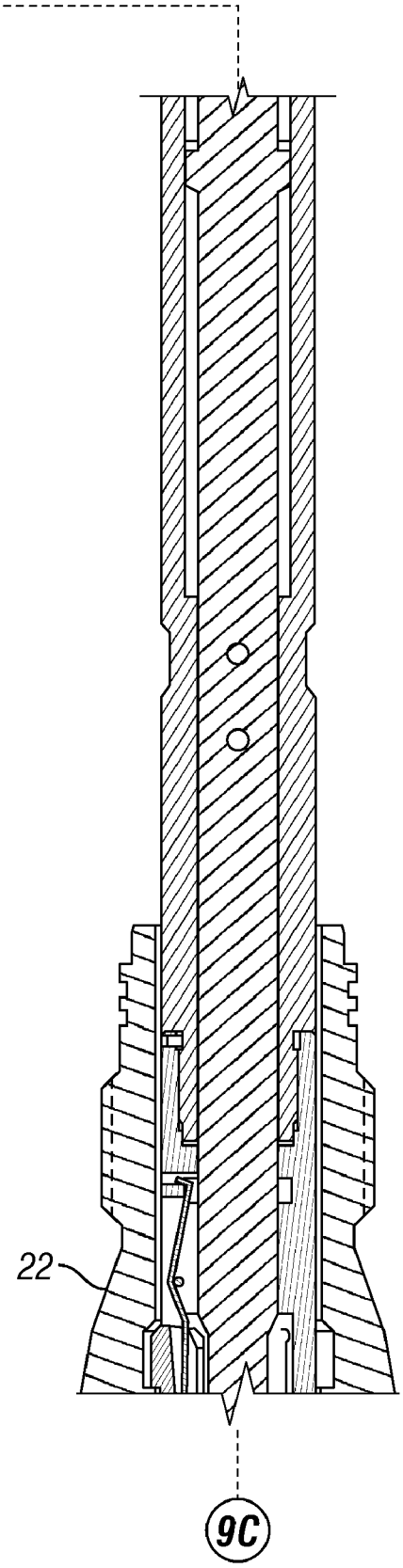
Figure 9C:
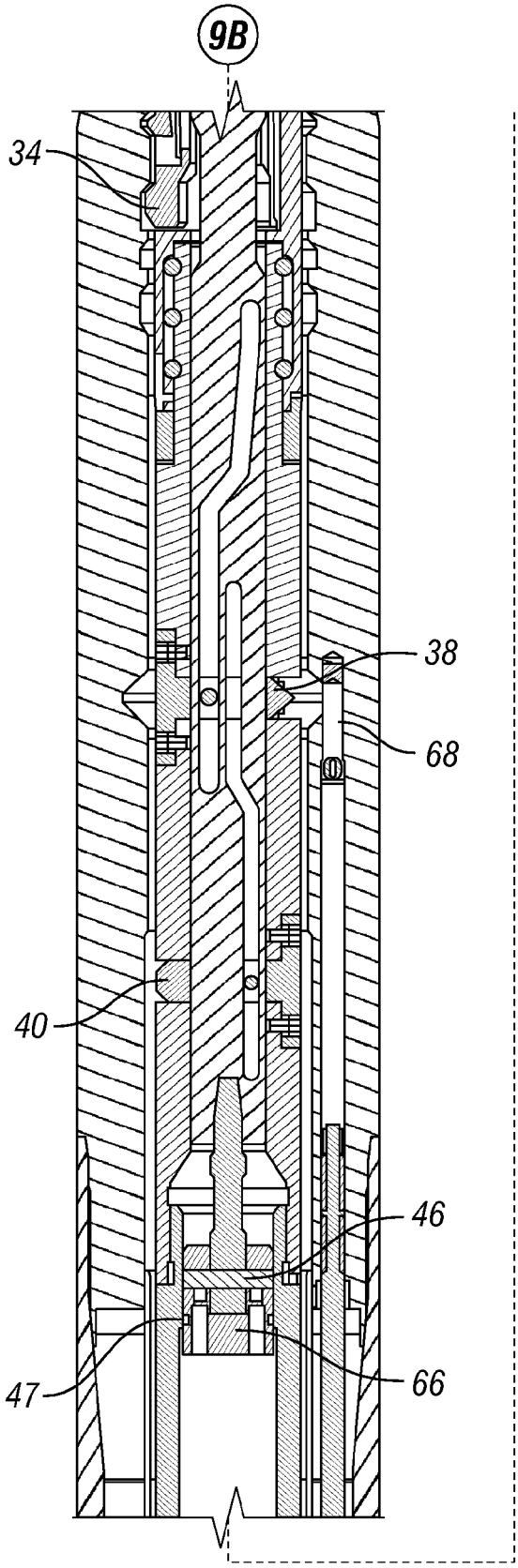
Figure 9D:
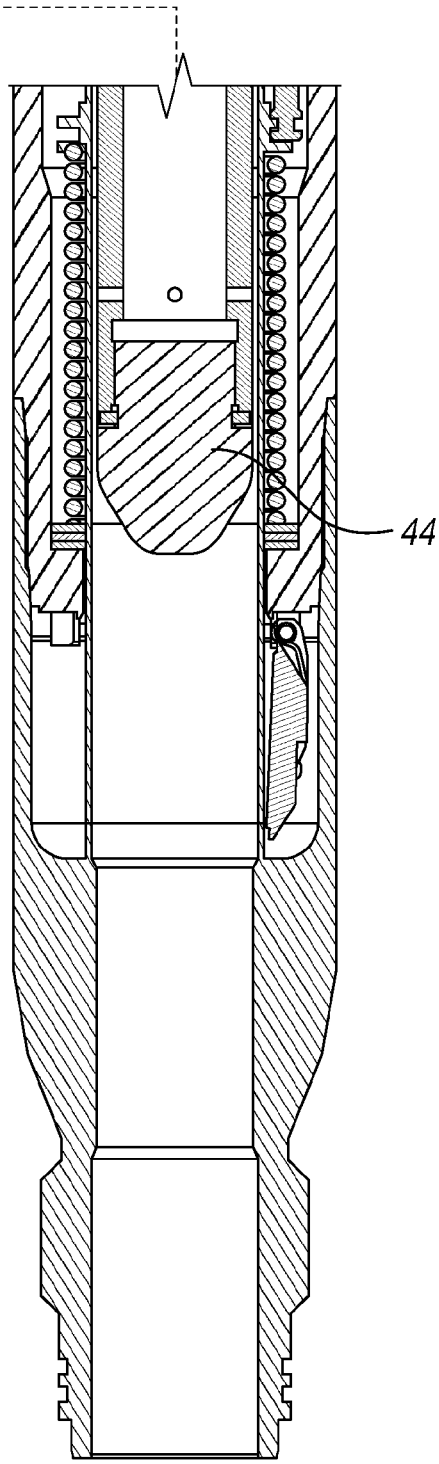

Further referring to FIGS. 8C-D, a hydraulic piston 78 is mounted inside a non-annular piston bore and connects to a flow tube 80. The flow tube 80 may be shifted via hydraulic pressure acting on the piston 78 to extend through a flapper 82 to open the safety valve. If hydraulic pressure is lost, a power spring 84 will force the flow tube 80 upwardly above the flapper 82, thereby allowing the flapper 82 to pivot to the closed position and to prevent flow of well bore fluids up through the safety valve 22. Although not shown in detail, it is understood that the flow tube 80 is locked in the open position prior to the insertion of the communication tool 20. Various methods of locking open the TRSSSV 22 are known.

The communication tool 20 is shown in the indexing position in FIGS. 9A-9D. The indexing position is a tool state when the central prong 24 is located under the lock dogs 34 effectively latching the tool 20 in the TRSSSV 22. When the central prong 24 is in this position, the snap ring 47 on the lock piston 66 having expanded fully within the lower housing limiting any further upward motion from the central prong 24 (i.e., cannot come out from underneath the extended lock dogs). To release the central prong 24 from this position, the operator must jar on the communication tool 20 to shear the pulling shear pin 46. Stroking up and down between this position and the full down position will cause the cutter housing and cutter 38 to rotate. When this action is continued, the cutter 38 will eventually extend into an exposed portion of the communication component 68.

Figure 10A:
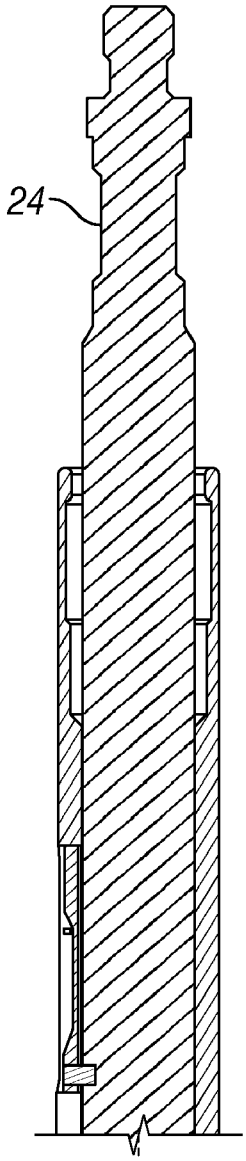
FIGS. 10A-10D show the communication tool of FIGS. 8A-8D in the full down jarring position.
Figure 10B:
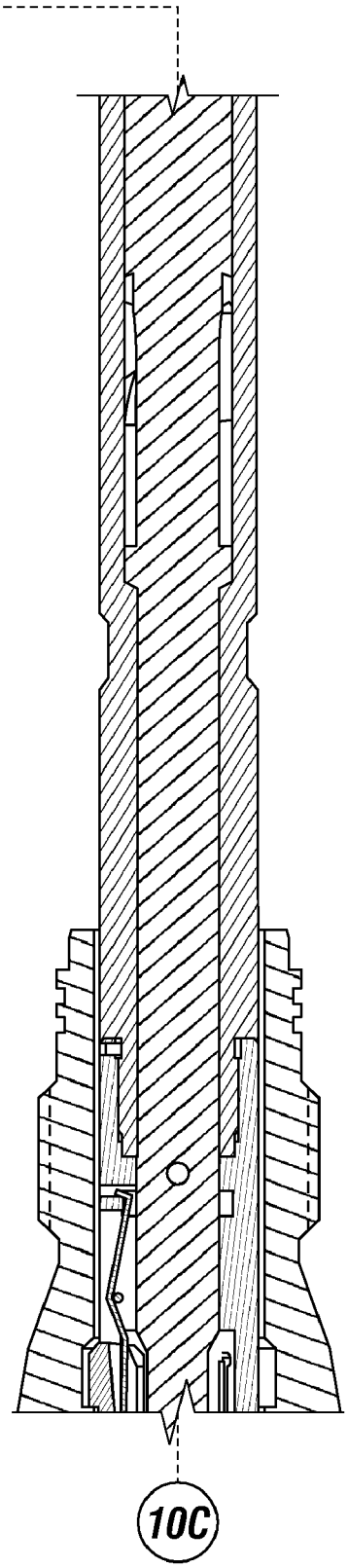
Figure 10C:
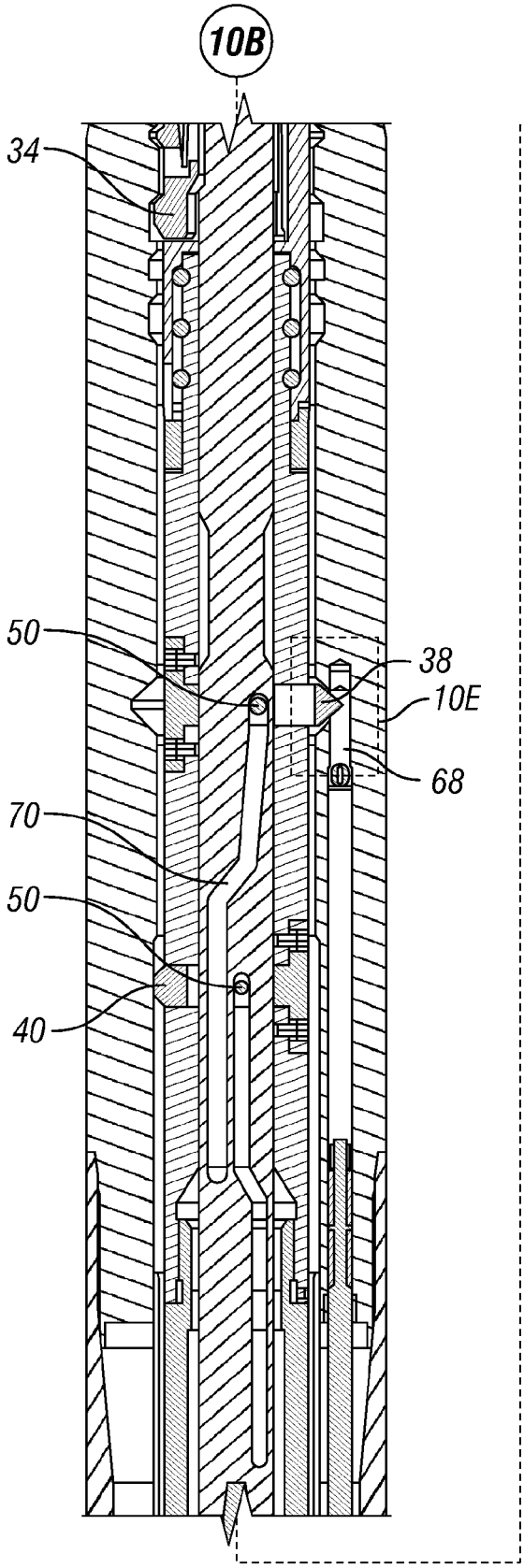
Figure 10D:
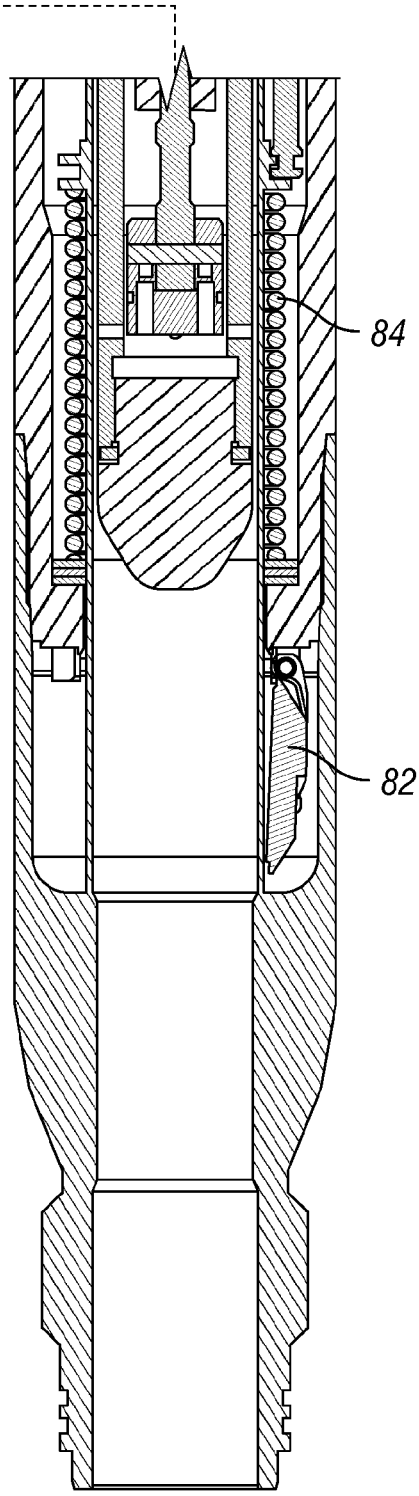
Figure 10E:
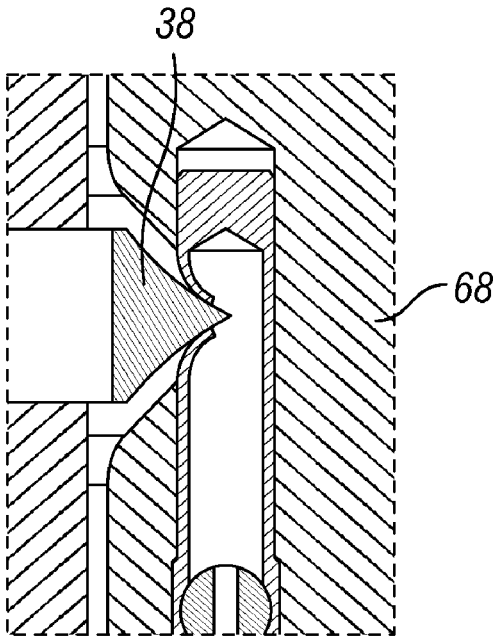
FIG. 10E shows the communication component, as seen in FIGS. 8C and 10C, being severed by a cutter.
Figure 11E:
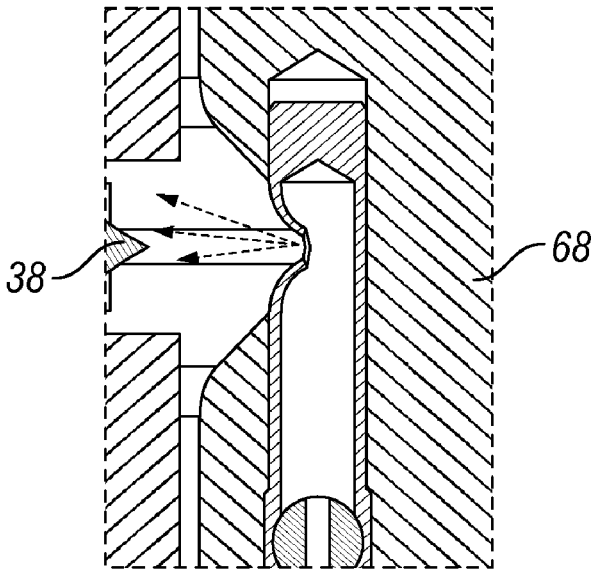
FIG. 11E shows the communication component, as seen in FIGS. 8C and 11C, having been severed by a cutter.
Figures 11A, 11B:
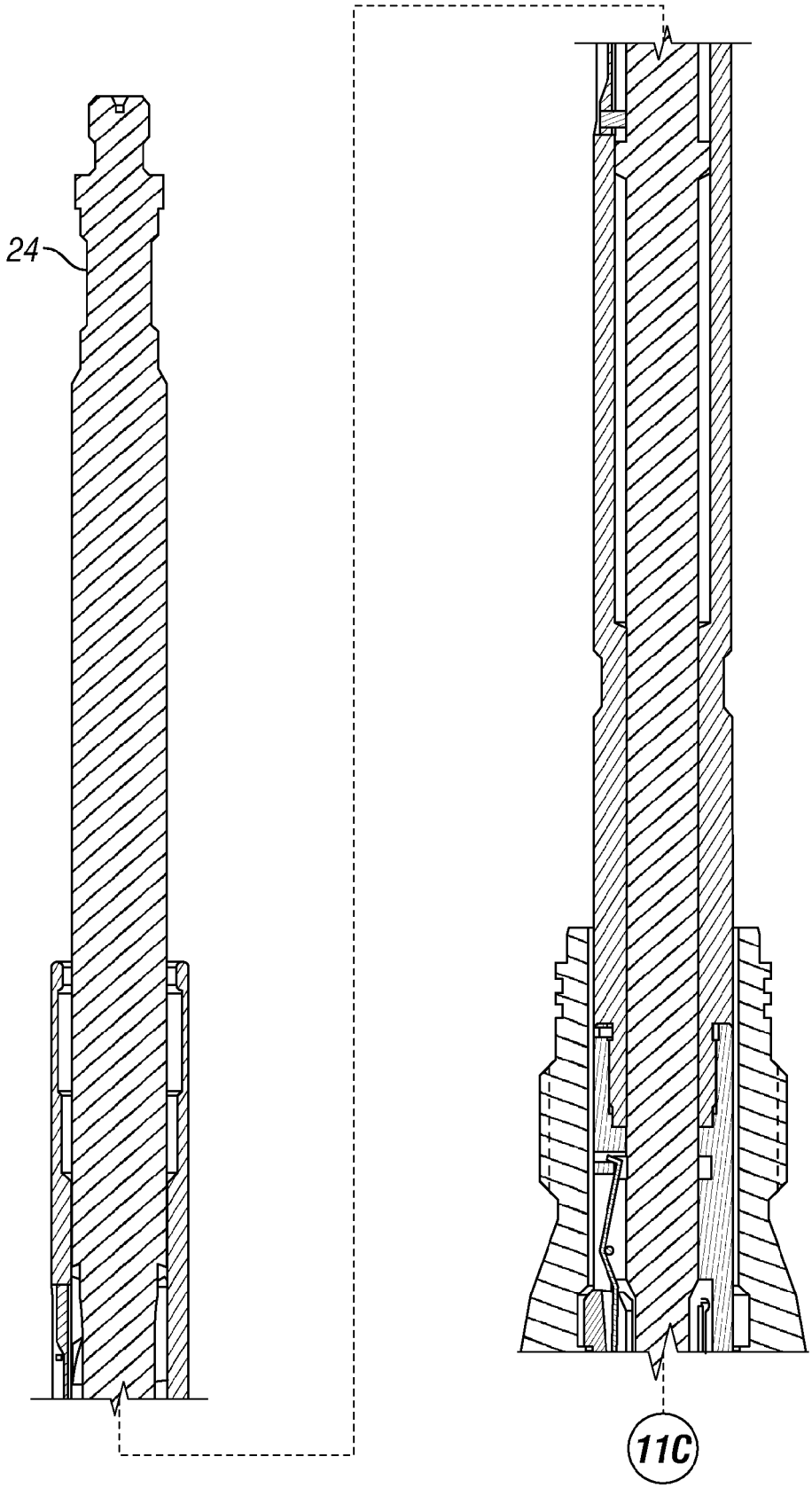
FIGS. 11A-11D show the communication tool of FIGS. 8A-8D in the recovery position.
Figure 11C:
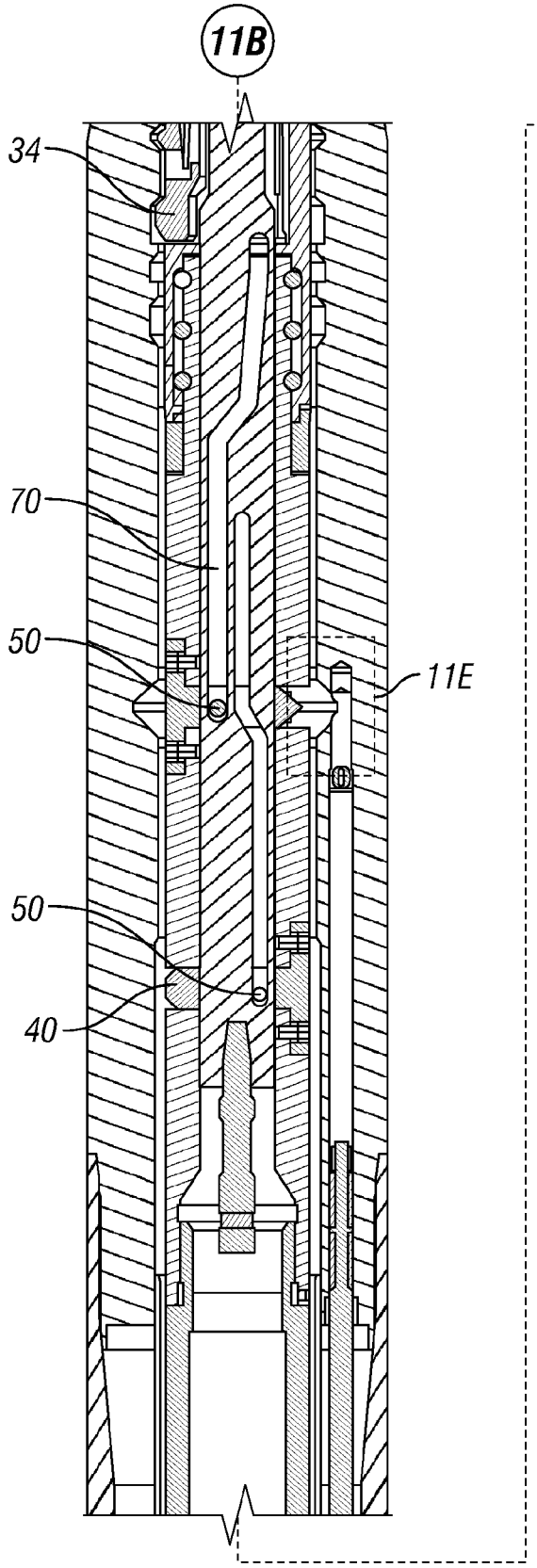
Figure 11D:
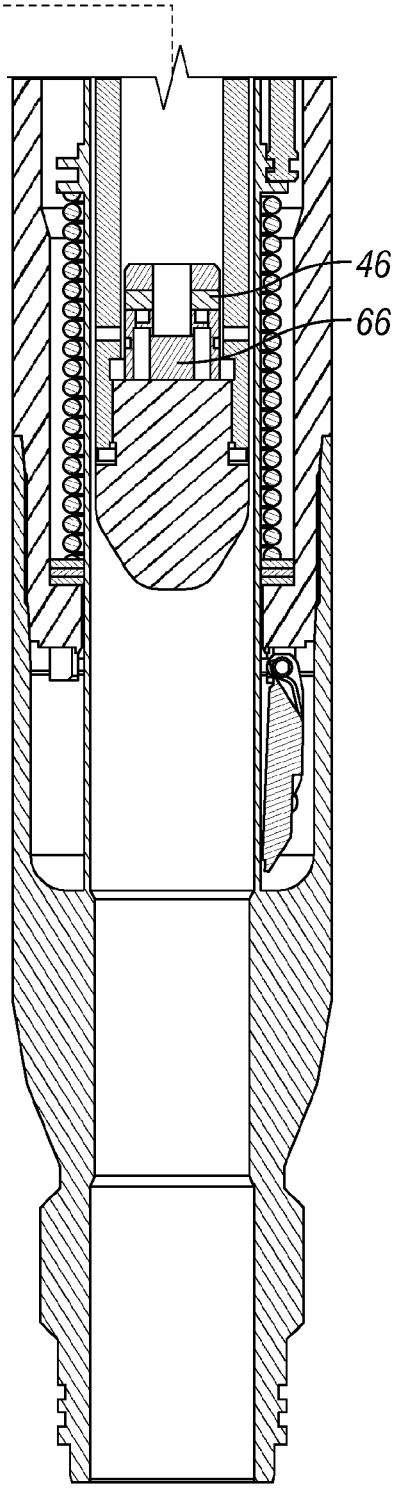

The full down jarring position for the communication tool 20 is illustrated in FIGS. 10A-10D. The full down position is a tool state that represents the full stroke limit of the communication tool 20. When the central prong 24 is fully jarred down, the slots 70 on the central prong 24 extend both the cutter 38 and the reaction dog 40 as extension pins 50 track slots 70. If the communication component 68 of the TRSSSV 22 is in front of a cutter 38, the jarring will sever the component 68 thus establishing hydraulic communication. The reaction dog 40 backs up the cutter 38 and takes radial play out of the tool 22. FIGS. 10C, 10E and 11E illustrate the communication component 68 being severed by the cutter 38.

The recovery position of the communication tool 20 is illustrated in FIGS. 11A-D. The recovery position is when the central prong 24 has been jarred up such that the pulling shear pin 46 within the lock piston 66 is severed. When the central prong 24 is pulled up, the cutter 38, reaction dog 40 and locked dogs 30 all retract as extension pin 50 tracks down slots 70. The locked piston 66 will fall to the bottom of the lower housing. The tool will need to be redressed prior to any re-deployment.

Figure 12A:
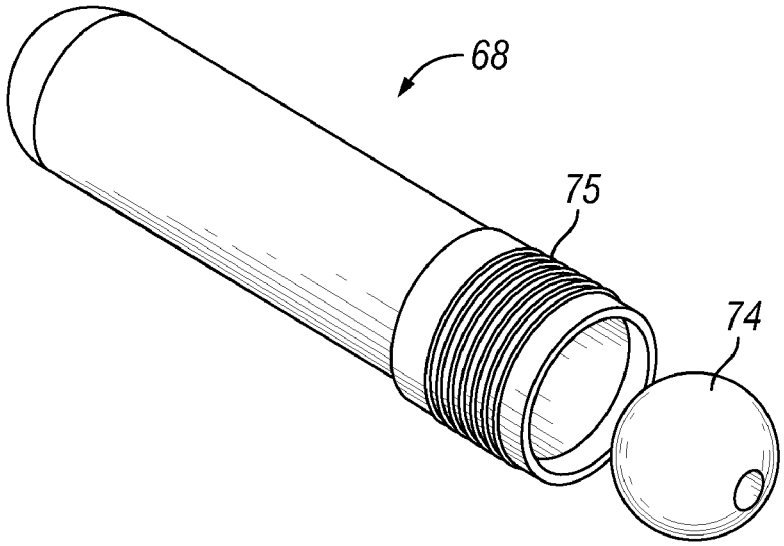
FIGS. 12A-12C show one embodiment of the communication component of the TRSSSV.
Figure 12B:
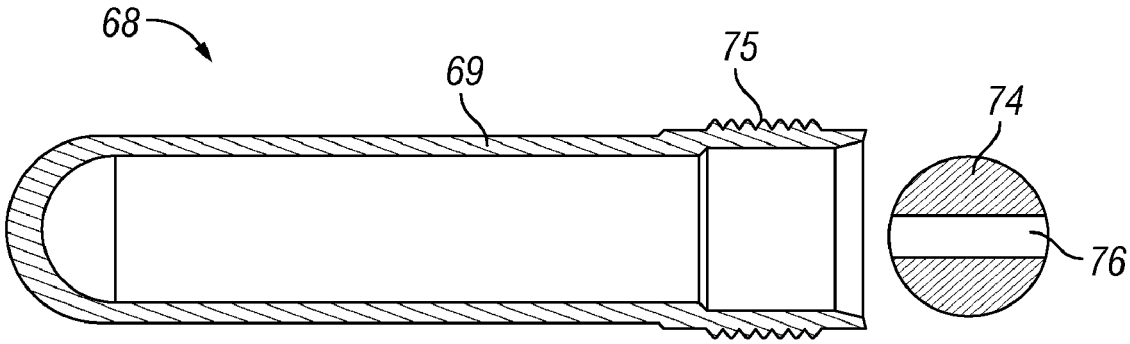
Figure 12C:
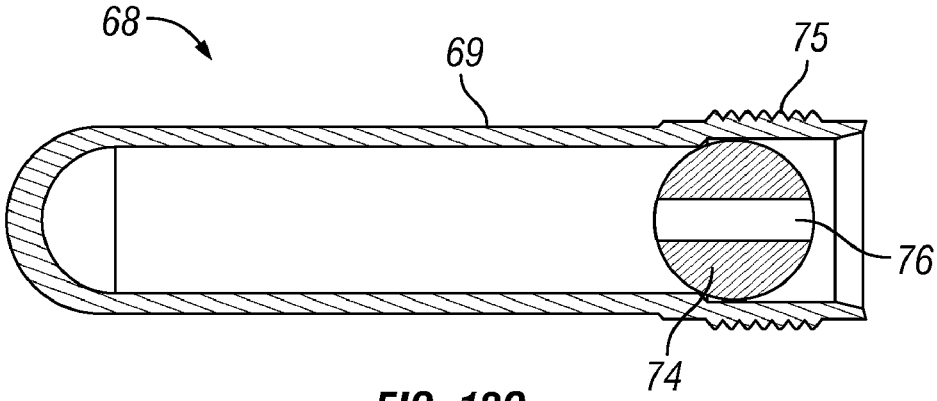

FIGS. 12A-12C show one exemplary embodiment of the communication component 68 of the TRSSSV 22. Communication component 68 comprises a body 69 and a communication retention ball 74. The communication component body 69 is first installed into the hydraulic conduit within the TRSSSV hydraulic chamber housing. Sealing grooves 75 are provided on the lower end of the body 69. When the retention ball 74 is pressed into the communication plug body 69, a high contact pressure, metal-to-metal seal between the sealing groves 75 of the body and the hydraulic conduit wall is established, effectively isolating the hydraulics from the inside of the TRSSSV 22. Once the communication component 68 is broken by cutter 38, the hydraulic fluid will be able to communication through the fluid bypass passage 76 extending through the retention ball 74 into the bore of the TRSSSV 22. The communication component 68 is made of a frangible material that may be cut, pierced, sheared, punctured, or the like. During normal operations of the TRSSSV 22, the communication component is protected in the sidewall of the hydraulic chamber housing. In a preferred embodiment, body 69 is made of 718 Inconel or 625 stainless steel and ball 74 is made of 316 or 625 stainless steel. Please note, however, that one ordinarily skilled in the art having the benefit of this disclosure would realize any variety of communications components, chambers, etc. could be utilized within the scope of this invention.

Although various embodiments have been shown and described, the invention is not so limited and will be understood to include all such modifications and variations as would be apparent to one skilled in the art. For example, the communication tool 20 could be used to establish communication with other types of downhole devices (i.e., devices other than a TRSSSV). Such tools may, or may not, include a communication component through which fluid communication is established with the communication tool. Thus, the present invention is not limited to establishing communication with a TRSSSV but may be used to establish communication with other types of downhole devices. Accordingly, the invention is not to be restricted except in light of the attached claims and their equivalents.

What is claimed is:

1. A communication tool to establish fluid communication between a control line and a downhole device, the communication tool comprising:

a housing having a bore therethrough;

a central prong extending inside the bore, the central prong being adapted to actuate up or down relative to the housing;

a cutter placed along the housing, the cutter being adapted to extend from the housing in order to rupture a communications component of the downhole device; and an indexing system inside the housing which is adapted to index the cutter around an axis of the communication tool, the indexing system being responsive to the actuation of the central prong, wherein the rupturing of the communications component is achieved without a need to radially align the cutter with the communications component prior to an initial extension of the cutter.

2. A communication tool as defined in claim 1, wherein the indexing system comprises:

an indexing profile along an outer surface of the central prong; and a plurality of indexing pins which track the indexing profile, thereby causing the central prong to index the cutter around the axis of the communications tool.

3. A communications tool as defined in claim 1, wherein the central prong comprises an internal profile used to force the cutter to retract into the housing or extend from the housing.

4. A method to establish fluid communication with a downhole device, the method comprising the steps of:

(a) running a communications tool into the downhole device, the communications tool having a cutter along a housing of the communications tool;

(b) extending the cutter from the housing of the communications tool, the cutter being adapted to repeatedly extend from and retract into the housing; and (c) rupturing a communications component of the downhole device using the extended cutter, wherein the rupturing is achieved without a need to radially align the extended cutter and the communications component prior to an initial extension of the cutter.

5. A method as defined in claim 4, wherein step (b) further comprises the step of indexing the cutter around an axis of the communications tool.

6. A method as defined in claim 5, wherein the indexing is accomplished by actuating a prong of the communications device upward.

7. A method as defined in claim 5, the method further comprising the step of repeatedly actuating a prong of the communications device upward, each upward actuation indexing the cutter a predetermined degree.

8. A method as defined in claim 4, wherein step (a) further comprises the step of locking the communications tool into a selected position within the downhole device.

9. A method as defined in claim 4, wherein step (b) is accomplished by actuating a prong on the communications tool downward.

10. A method as defined in claim 4, further comprising the steps of retracting the extended cutter into the housing of the communications tool, and removing the communications tool from the downhole device.

11. A method as defined in claim 4, wherein the cutter is extended radially from the housing of the communications tool.

12. A method as defined in claim 4, the method further comprising the steps of:

inserting a wireline retrievable susbsurface safety valve ("WRSSSV") into the downhole device; and communicating with the WRSSSV via the ruptured communications component of the downhole device.

13. A method as defined in claim 12, wherein the step of communicating with the WRSSSV comprises the steps of:

passing fluid through a control line and into a hydraulic conduit in communication with the ruptured communications component;

passing the fluid from the hydraulic conduit through the ruptured communications component; and passing the fluid into the WRSSSV.

14. A method to establish fluid communication with a first downhole device, the method comprising the sequential steps of:

(a) running a communications tool into the first downhole device, the communications tool having a cutter along a housing of the communications tool;

(b) extending the cutter from the housing of the communications tool;

(c) retracting the cutter;

(d) indexing the retracted cutter around an axis of the communications tool;

(e) extending the cutter from the housing of the communications tool; and (f) rupturing a communications component of the first downhole device.

15. A method as defined in claim 14, wherein steps (b) through (e) are accomplished by actuating a prong of the communications tool.

16. A method as defined in claim 14, the method further comprising the steps of:

removing the communications tool from the first downhole device;

inserting a second downhole device into the first downhole device; and communicating with the second downhole device via the ruptured communications component of the first downhole device.

17. A method as defined in claim 16, wherein the step of communicating with the second downhole device comprises the steps of:

passing fluid into a control line being in communication with the ruptured communications component, the ruptured communications component being installed within a housing of the first downhole device adjacent a bore of the first downhole device;

passing the fluid from the control line and through the ruptured communications component, the fluid flowing through a retention ball located inside the ruptured communications component; and passing the fluid into the second downhole device.

18. A method as defined in claim 14, wherein the cutter is extended radially from the housing of the communications tool.

19. A communication tool to establish fluid communication between a control line and a downhole device, the communication tool comprising:

a housing; and a cutter placed along the housing, the cutter being adapted to extend from the housing in order to rupture a communications component of the downhole device;

wherein the communications component is ruptured without a need to radially align the cutter with the communications component prior to an initial extension of the cutter, and wherein the communication tool further comprises an indexing system adapted to index the cutter around an axis of the communication tool.

* * * * *

UNITED STATES PATENT AND TRADEMARK OFFICE

CERTIFICATE OF CORRECTION

PATENT NO. : 7,918,280 B2
APPLICATION NO. : 12/030725
DATED : April 5, 2011
INVENTOR(S) : Jason C. Mailand and Bahr A. Glenn It is certified that error appears in the above-identified patent and that said Letters Patent is hereby corrected as shown below:

Col. 8, claim 12 should read as follows:

-- 12. A method as defined in claim 4, the method further comprising the steps of: inserting a wireline retrievable subsurface safety valve ("WRSSSV") into the downhole device; and communicating with the WRSSSV via the ruptured communications component of the downhole device. --

Signed and Sealed this
Twenty-fourth Day of January, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,918,280 B2
APPLICATION NO. : 12/030725
DATED : April 5, 2011
INVENTOR(S) : Jason C. Mailand and Bahr A. Glenn It is certified that error appears in the above-identified patent and that said Letters Patent is hereby corrected as shown below:

Col. 8, lines 54-59, claim 12 should read as follows:

-- 12. A method as defined in claim 4, the method further comprising the steps of: inserting a wireline retrievable subsurface safety valve ("WRSSSV") into the downhole device; and communicating with the WRSSSV via the ruptured communications component of the downhole device. --

This certificate supersedes the Certificate of Correction issued January 24, 2012.

Signed and Sealed this
Fourteenth Day of February, 2012

David J. Kappos

David J. Kappos
*Director of the United States Patent and Trademark Office*